US011166542B2

(12) United States Patent
Sze

(10) Patent No.: US 11,166,542 B2
(45) Date of Patent: Nov. 9, 2021

(54) HAIR BRUSH

(71) Applicant: Tung Hing Plastic Manufactory Ltd., Hong Kong (HK)

(72) Inventor: Ka Chuen Sze, Hong Kong (HK)

(73) Assignee: Tung Hing Plastic Manufactory Limited, Hong Kong (HK)

( * ) Notice: Subject to any disclaimer, the term of this patent is extended or adjusted under 35 U.S.C. 154(b) by 233 days.

(21) Appl. No.: 16/517,917

(22) Filed: Jul. 22, 2019

(65) Prior Publication Data

US 2020/0288851 A1 Sep. 17, 2020

Related U.S. Application Data

(63) Continuation-in-part of application No. 29/683,117, filed on Mar. 11, 2019, now Pat. No. Des. 913,703.

(51) Int. Cl.
*A46B 5/00* (2006.01)
*A46B 9/02* (2006.01)

(52) U.S. Cl.
CPC ..... *A46B 5/0025* (2013.01); *A46B 9/023* (2013.01); *A46B 9/026* (2013.01); *A46B 2200/104* (2013.01)

(58) Field of Classification Search
CPC ..... A46B 9/023; A46B 9/026; A46B 5/00; A46B 15/00; A46B 5/0025
See application file for complete search history.

(56) References Cited

U.S. PATENT DOCUMENTS

| | | | | |
|---|---|---|---|---|
| 825,910 A * | 7/1906 | Kleinsorgen | A46B 7/06 15/201 |
| 6,308,717 B1 * | 10/2001 | Vrtaric | A46B 9/023 132/129 |
| D739,660 S * | 9/2015 | Rennette | D4/138 |
| D750,896 S * | 3/2016 | Park | D4/136 |
| 2013/0206183 A1 * | 8/2013 | Shim | A46B 5/0025 134/32 |

FOREIGN PATENT DOCUMENTS

| | | |
|---|---|---|
| KR | 00010254672 B1 | 4/2013 |
| TW | M516351 U | 2/2016 |
| WO | 2018/040454 A1 | 3/2018 |

OTHER PUBLICATIONS

Amazon, BESTOOL detangling brush, Amazon.co.uk [online], accessed Aug. 11, 2019.

* cited by examiner

*Primary Examiner* — Shay Karls
(74) *Attorney, Agent, or Firm* — Melvin Li

(57) ABSTRACT

The present invention provides an improved hair brush. The hair brush has an elongate profile defining a first longitudinal axis, has a handle portion in the form of a stick sharing the first longitudinal axis and provided with a proximal end and an distal end, and further comprises a utility portion extending from the distal end of the handle portion for engaging the hair and the scalp of a user during use. The utility portion includes at least a first floating finger and a second floating finger forking off from the distal end of said handle portion, with both the first floating finger and the second floating finger provided with brushing members but independently and flexibly movable in any direction transverse to the longitudinal axis such that the first and second floating members can separately adjust in position in use.

14 Claims, 5 Drawing Sheets

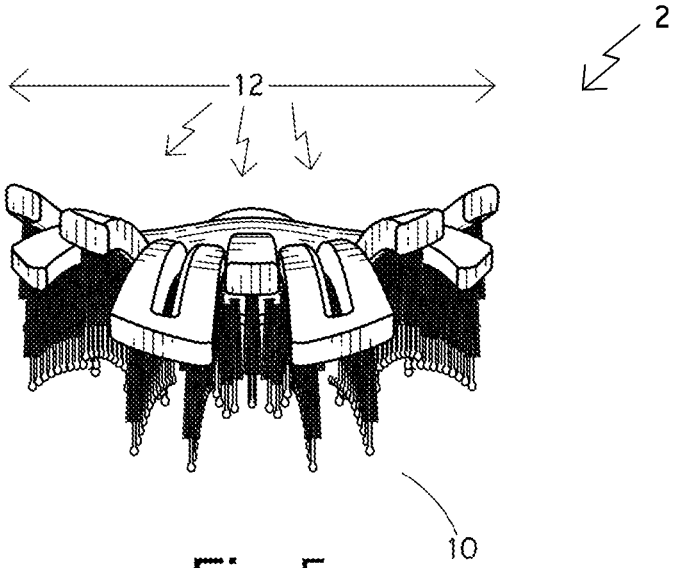
Fig.5
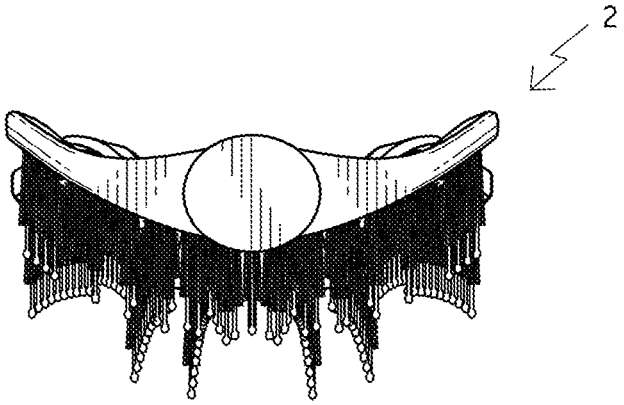
Fig.6
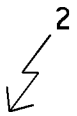

HAIR BRUSH

CROSS REFERENCE TO RELATED APPLICATION

The present application is a Continuation-in-part application from earlier filed U.S. patent application Ser. No. 29/683,117 filed Nov. 3, 2019, contents of which are incorporated herein in their entirety.

FIELD OF THE INVENTION

The present invention is concerned with a hair comb, and in particular a hair comb with a utility portion having a plurality fingers independently movable irrespective of each other.

BACKGROUND OF THE INVENTION

There are a variety of hair management tools in the market. For example, there are various types of traditional hair combs and conventional hair brushes such as cushion hair brushes. While different hair management tools are useful in addressing different hair styling needs, there exists a need for a hair management tool which can address different regions of a hair style of a user. Further, there also exists a need for a hair styling tool which can suit a variety of users with a wide ranging hair volume and thickness and style.

The present invention seeks to address, for example, the aforementioned needs, or at least to provide an alternative to the public.

SUMMARY OF THE INVENTION

According to a first aspect of the present invention, there is provided a hair brush with an elongate profile defining a first longitudinal axis, the hair brush comprises a handle portion in the form of a stick sharing the first longitudinal axis and provided with a proximal end and an distal end, and the hair brush further comprises a utility portion extending from the distal end of said handle portion for engaging the hair and the scalp of a user during use, wherein:

the utility portion includes at least a first floating finger and a second floating finger forking off from the distal end of the handle portion; and both the first floating finger and the second floating finger are provided with brushing members but independently and flexibly movable in any direction transverse to the longitudinal axis such that the first and second floating members can separately adjust in position in response to different areas of the hair or scalp of a user, different hair configurations or head shapes of different users.

Preferably, the first floating finger may have an elongate profile extending from the distal end of the handle portion to a distal end of the hair brush. The second floating finger may have an overall elongate profile extending from the distal end of the handle portion to the distal end of the hair brush and an internal structure resembling a zigzagging path across a transverse plane of the hair brush. In an embodiment, the zigzagging path may take the form of a loop or closed loop. The hair brush may comprise a third floating finger with an elongate profile extending from the second floating finger.

Suitably, the hair brush, in addition to the first, second and third floating fingers, may comprise at least a fourth floating finger. The first, third and fourth floating fingers may define respective longitudinal axes which are not in parallel with each other or with the first longitudinal axis. Partly due to difference in axial configuration of the floating fingers, the brushing members extending from the floating fingers may be configured to be able to reach different depths of hair configurations of a user during a hair styling exercise.

In an embodiment, the hair brush may comprise eight such floating members altogether. The eight floating members may be fanned out towards the distal end of the hair brush.

In one embodiment, the floating fingers may be of different lengths. For example, the floating fingers arranged on the leftmost and rightmost side may be shorter while the floating fingers arranged in the middle region of the utility portion are longer.

Advantageously, the brushing members may include bristles or filaments, or both. In one embodiment, the bristles or filaments from the floating fingers may have the same length, for example, for ease of manufacture. In an alternative embodiment, the bristles or filaments from the floating fingers may have different lengths configured to reach or to provide further accommodation to different hair volume or different hair thickness.

In one embodiment, the first and second floating fingers may define different planes and the planes do not coincide with each other.

In some embodiments, outwardly facing sides of the first and second fingers may define respective surfaces which do not lie or share a same plane.

According to a second aspect of the present invention, there is provided a hair brush with an elongate profile defining a first longitudinal axis, the hair brush comprises a handle portion in the form of a stick sharing the first longitudinal axis and provided with a proximal end and an distal end, and the hair brush further comprises a utility portion extending from the distal end of the handle portion for engaging the hair and the scalp of a user during use, wherein:

the utility portion includes at least a first floating finger and a second floating finger forking off from the distal end of the handle portion; and the first and second floating fingers define different planes in that the planes do not coincide with each other.

Preferably, both the first floating finger and the second floating finger may be provided with brushing members but independently and flexibly movable in any direction transverse to the first longitudinal axis such that the first and second floating members can separately adjust in position in response to different areas of the hair or scalp of a user, different hair configurations or head shapes of different users.

Suitably, the first floating finger may have an elongate profile extending from the distal end of the handle portion to a distal end of said hair brush, the second floating finger may have an overall elongate profile extending from the distal end of the handle portion to the distal end of the hair brush and an internal structure resembling a zigzagging path across a transverse plane of the hair brush, the hair brush may comprise a third floating finger with an elongate profile extended from the second floating finger, and the utility portion, in addition to the first and second floating fingers, may comprise at least a fourth floating finger.

In an embodiment, the first, second, third and fourth floating fingers may define respective longitudinal axes which are not in parallel with each other.

Partly due to difference in axial configuration of the floating fingers, the brushing members may be configured to be able to reach different depths of hair configurations of a user during a hair styling exercise.

BRIEF DESCRIPTION OF PREFERRED EMBODIMENTS OF THE INVENTION

Some embodiments of the present invention will now be explained, with reference to the accompanied drawings, in which:—FIGS. 1 and 3 are top and bottom views of an embodiment of a new hair brush design according to the present invention;

FIGS. 5 and 6 are front and rear views of the hair brush of FIG. 1.

DETAILED DESCRIPTION OF PREFERRED EMBODIMENTS OF THE INVENTION

The present invention is concerned with a hair brush, and is illustrated and explained by way of embodiments below with reference to the accompanied drawings. A first embodiment of a hair brush is shown in FIGS. 1 to 9. The hair brush, generally designed 2, has an elongate profile extending from a proximal end to a distal end thereof.

Figures 1, 2:
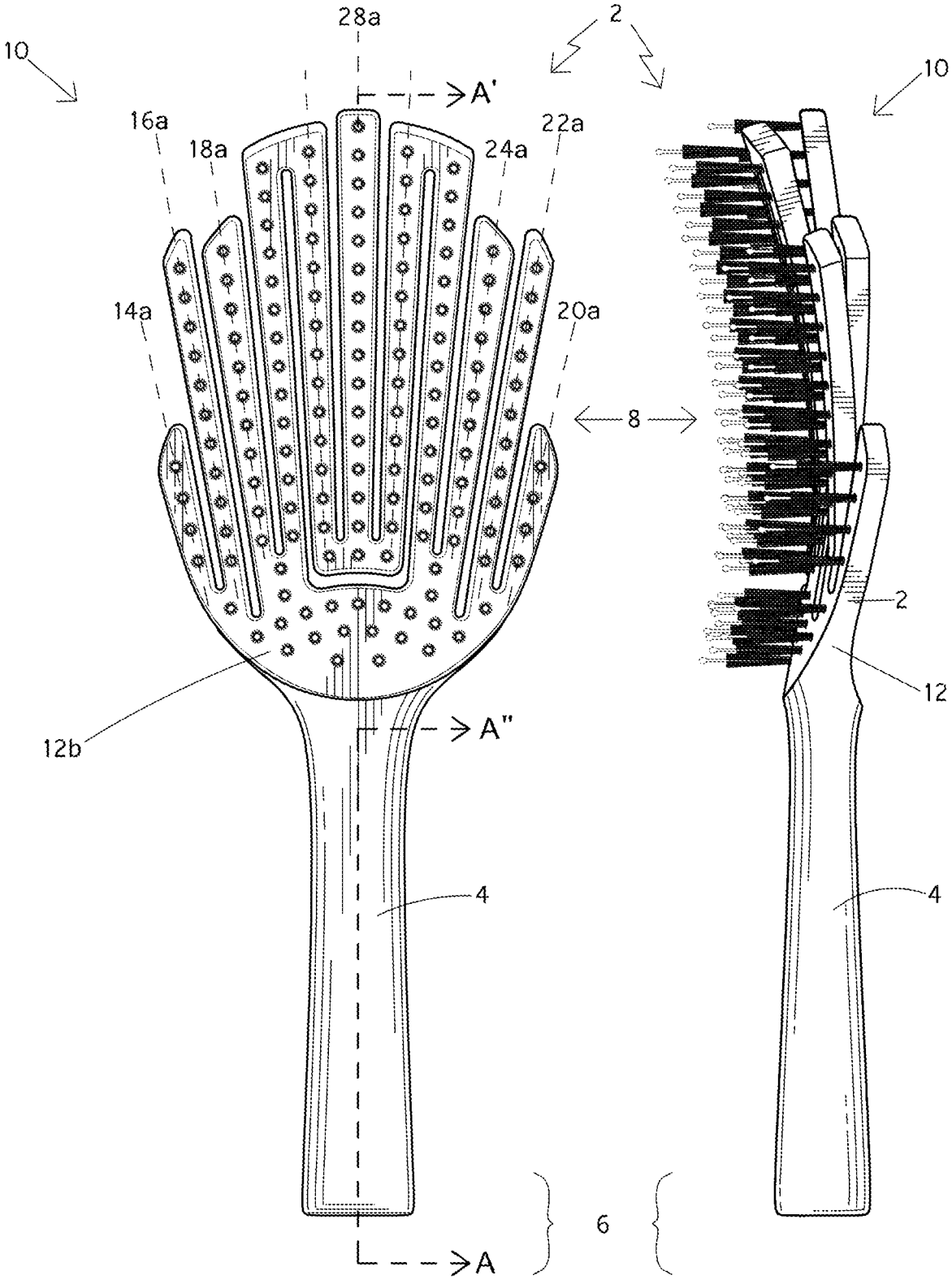
FIGS. 2 and 4 are opposite side views of the hair brush of FIG. 1.

FIGS. 1 and 2, for example, show the hair brush 2 in that it comprises a handle portion 4 at the proximal end 6 and a utility portion 8 at the distal end 10. In use, a user would hold on to the handle portion 4 to control or otherwise maneuver movement of the utility portion 8 such that the utility portion 8 engages hair and scalp of the user for hair management in a hair styling exercise. The elongate hair brush 2 defines a longitudinal axis A-A' illustrated in, for example, FIGS. 1 and 3.

The handle portion 4 is in the form of a stick handle and likewise has a proximal end and a distal end. The handle portion with a longitudinal axis A-A" extends along the longitudinal axis A-A' of the hair brush 2. Please see FIG. 3.

Figure 3:
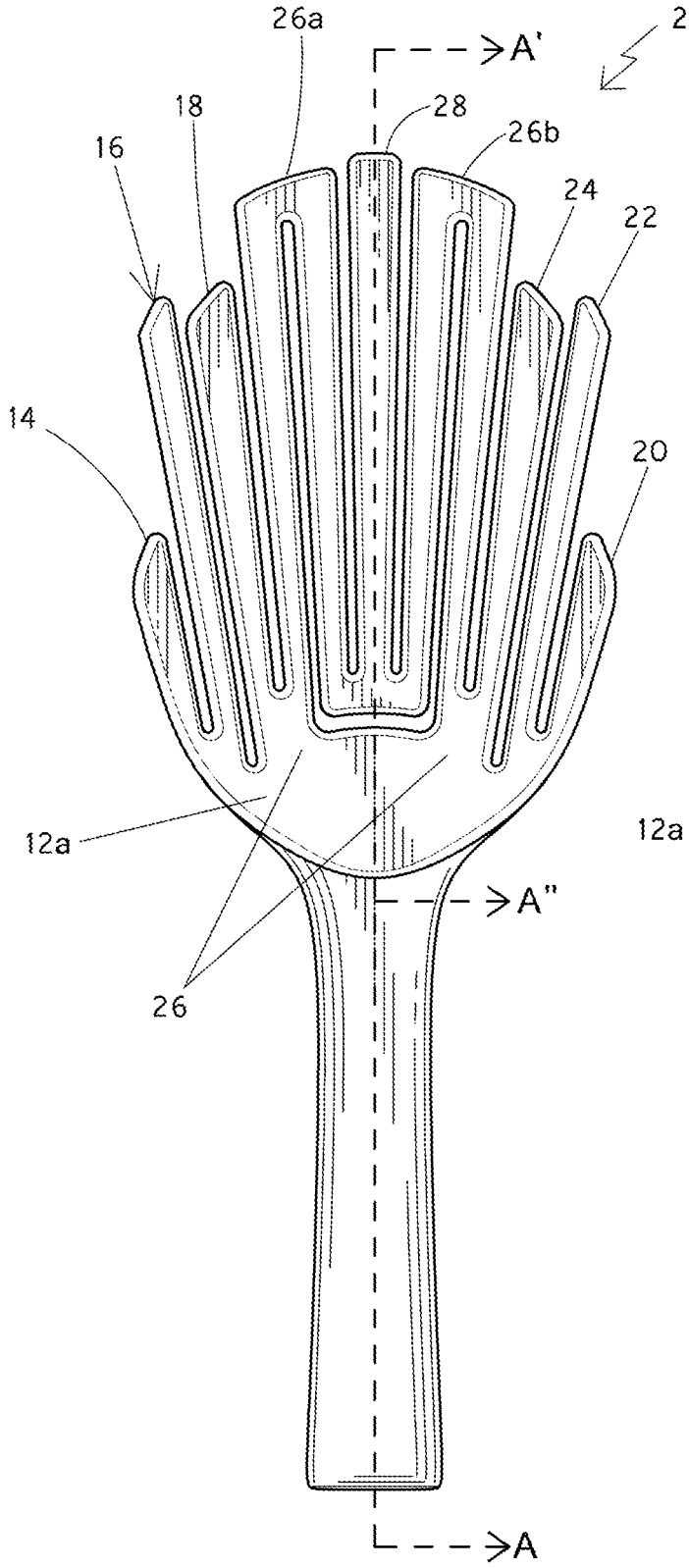
Figure 4:
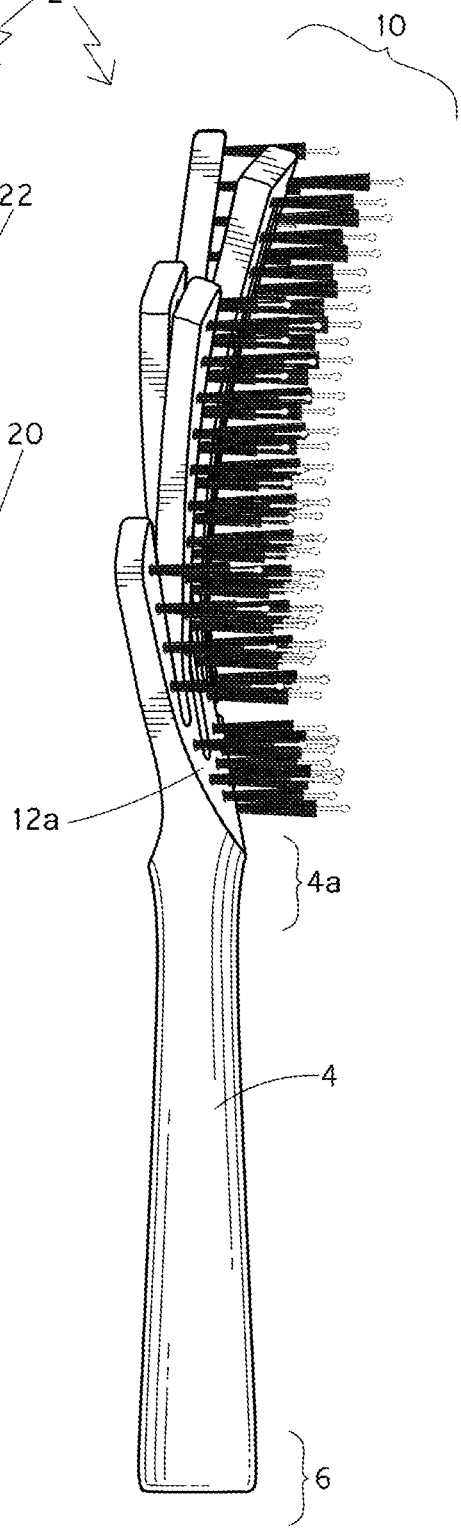

Referring to FIG. 4, the utility portion 8 extends from a distal end 4*a* of the handle portion 4 to the distal end 10 of the hair brush 2. FIG. 5 shows the distal end 10 of the hair brush 2 while FIG. 6 shows the proximal end 6 of the handle portion 4/hair brush 2. The utility portion 8 includes a support member 12 defining a rearwardly facing surface 12*a* (see FIGS. 2-4) and a forwardly facing surface 12*b* from which brushing members 14 extend (see FIGS. 1-2 and 4). The oppositely pointing arrows in FIG. 5 show the support member 12 laterally extending. In use, the forwarding facing surface 12*b* (as shown in FIG. 1) faces the user while the rearwardly facing surface 12*a* (as shown in FIG. 3) faces away the user. In this embodiment, the support member 12 of the utility portion 8 and the handle portion 4 are integrally formed, for example, by injection molding in one injection molding step.

The utility portion 8 is provided with a plurality of members extending from the proximal end to the distal end thereof. While the plurality of members are different in configuration they generally resemble elongate fingers and the support member 12 of the utility portion 8 as a whole resemble a palm with the multiple fingers extending therefrom. In this embodiment, the plurality of fingers can be classified into three categories.

A first category of the elongate members include finger 14. Referring to FIG. 3, the finger 14, it is the shortest or one of the shortest among the fingers. It is arranged at a farthest lateral side of the utility portion 8. Further towards an inner region of the supporting member 12 is provided with fingers 16, 18. The fingers 16, 18 are similar to the finger 14 although they are longer and/or wider than the finger 14. Fingers 20, 22, 24 generally correspond to the fingers 14, 16, 18, respectively, in profile, except they arranged at the opposite lateral side of the utility portion 8.

A second category of the elongate members include finger 26 which has a more complicated structure. Specifically, while its overall configuration is also elongate in profile, it extends from the base of the utility portion 8 and has a zigzagging structure formed from a loop or closed path. The zigzagging structure defines a recess or a gap sandwiched by two symmetric prongs 26*a*, 26*b*.

A third category of the elongate members includes finger 28. The finger 28 is positioned between the two prongs 26*a*, 26*b* and extends from a base region of the finger 26 to the distal end of the hair brush 2.

Regardless of the configuration of the fingers 14, 16, 18, 20, 22, 24, 26, 28, they all generally extend from the proximal end to the distal end of the utility portion 8. Specifically, the fingers 14, 16, 18, 20, 22, 24, 26 extend and fork off from a base region of the support member 12 towards the distal end of the utility portion 8.

In addition to the difference of the configuration of the different fingers 14, 16, 18, 20, 22, 24, 26, 28, they also differ with respect to their dimensional or special orientations. FIG. 1 illustrates that the fingers define their respective longitudinal axes 14*a*, 16*a*, 18*a*, 20*a*, 22*a*, 24*a*, 28*a* along their respective lengths. These longitudinal axes 14*a*, 16*a*, 18*a*, 20*a*, 22*a*, 24*a*, 28*a* are not in parallel with each other. Further, these longitudinal axes 14*a*, 16*a*, 18*a*, 20*a*, 22*a*, 24*a*, 28*a* and the longitudinal axis of the hair brush 2 or the handle portion 4 are not in parallel with each other.

The finger 26 includes the two prongs resembling two wings, and the first prong 26*a* and the second prong 26*b* define their respective longitudinal axes. These longitudinal axes are not in parallel with each other.

The forking off or fanning apart of the elongate fingers 14, 16, 18, 20, 22, 24, 26, 28 from the base region of the support member 12 explains the respective longitudinal axes of the elongate fingers with different orientations.

Figure 7:
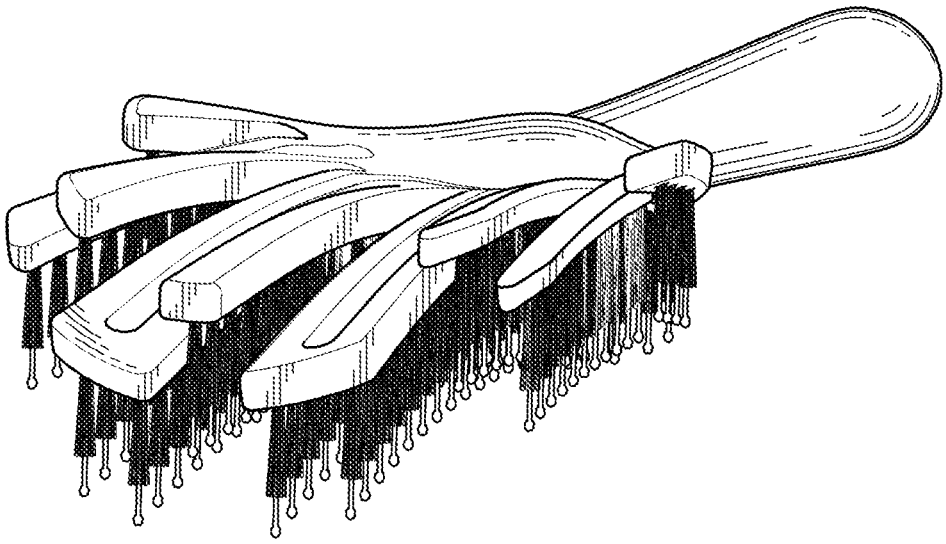
FIGS. 7, 8 and 9 are different perspective views of the hair brush of FIG. 1.
Figure 8:
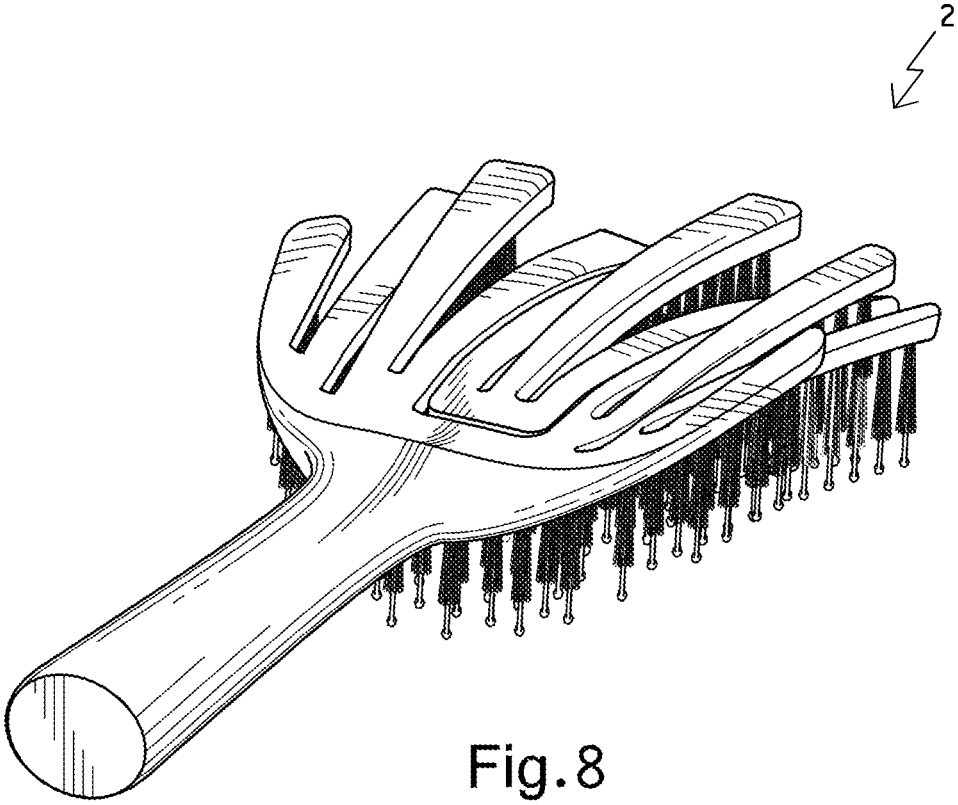

FIG. 7 and FIG. 8 illustrate another aspect of characteristics of the elongate fingers. The elongate fingers are different not only in that their respective longitudinal axes are not in parallel with each other. They are also different in that the longitudinal axes do not lie on a same plane. Specifically, FIG. 7 illustrates the different fingers resembling different keys of a piano keyboard depressed with different extent. Each of the fingers generally takes the form of a broad strip member and can be viewed as a piano key defining a lateral plane across the key. The different fingers thus resemble the different keys defining the respective different planes. As shown in, for example, FIG. 8, the different planes do not coincide with each other.

In this embodiment, the hair brush 2 is provided with eight elongate fingers. The brushing members extending from the forwardly facing surface thereof are made of a plurality of tufts including a combination of bristles and filaments. Also in this embodiment, the tufts from the fingers are of the same length for ease of manufacture. Alternatively, the tufts of the brushing members may be of different lengths. With this different construction, the utility portion 2 can produce an even larger extent or degree of accommodation to different volume, thickness and configuration of hair styles.

The proximal ends of the fingers are relatively narrower or thinner compared to distal ends. In any event, the fingers are configured such that they are flexibly movable. While the fingers define their respective longitudinal axes and they are resiliently flexible, they can resiliently and independently movable with their respective moving paths thus resembling floating fingers when the fingers engage with the hair and scalp of a user using a hair styling exercise and the fingers float in response. FIG. 7 shows that some of the fingers are more forwardly positioned while some are more rearwardly positioned. Some of the fingers are longer and some are shorter. Some are more adjustable and some are less. As such, the different fingers create a vast variation of finger moving patterns allowing the brushing members to cater to a vast variety of hair volumes, hair configurations and hair styles of different users. In addition, when a single user has different hair conditions in different regions of the hair style, the hair brush can also cater the hair styling needs of the different regions.

Figure 9:
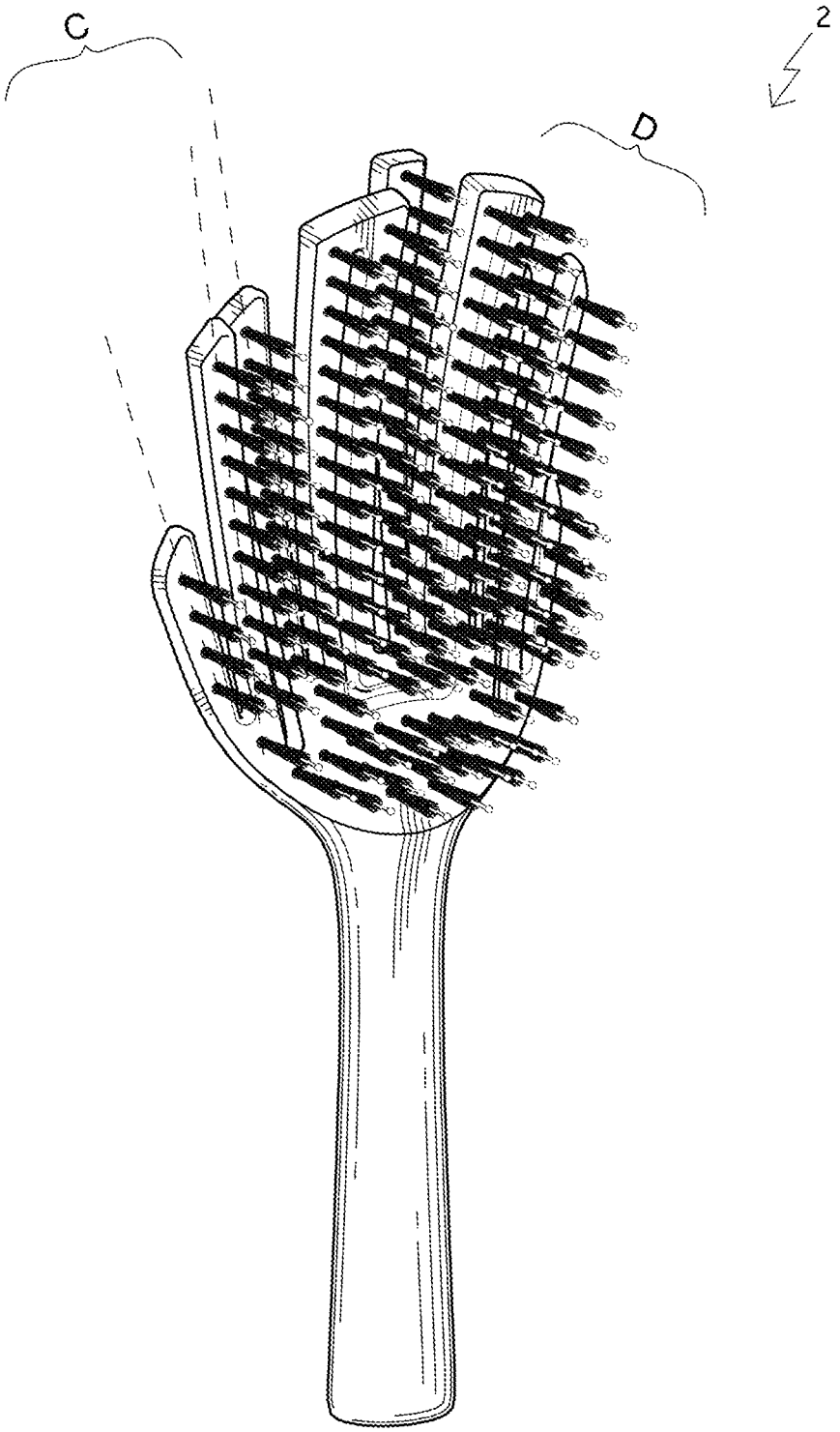

FIG. 9 further illustrates the spacial arrangement of the different fingers. The respective longitudinal axes are non-parallel with each other. Please see sign labeled "C", and the respective lateral extending planes defined by the piano-resembling fingers do not coincide or align with each other.

It should be understood that certain features of the invention, which are, for clarity, described in the content of separate embodiments, may be provided in combination in a single embodiment. Conversely, various features of the invention which are, for brevity, described in the content of a single embodiment, may be provided separately or in any appropriate sub-combinations. It is to be noted that certain features of the embodiments are illustrated by way of non-limiting examples. For example, while the bridge member as illustrated in the aforementioned embodiments are elongate, other suitable profiles or length of the bridge member may also be used. Also, a skilled person in the art will be aware of the prior art which is not explained in the above for brevity purp.

The invention claimed is:

1. A hair brush with an elongate profile defining a first longitudinal axis, said hair brush comprises a handle portion in the form of a stick sharing the first longitudinal axis and provided with a proximal end and an distal end, and said hair brush further comprises a utility portion extending from the distal end of said handle portion for engaging the hair and the scalp of a user during use, wherein:

said utility portion includes a plurality of floating fingers having at least a first floating finger, a second floating finger forking off from the distal end of said handle portion, a third floating finger and a fourth floating finger;

both said first floating finger and said second floating finger are provided with brushing members but independently and flexibly movable in any direction transverse to the longitudinal axis such that said first and second floating members can separately adjust in position in response to different areas of the hair or scalp of a user, different hair configurations or head shapes of different users;

said first floating finger has an elongate profile extending from the distal end of said handle portion to distal end of said hair bush;

said second floating finger has an overall elongate profile extending from the distal end of said handle portion to the distal end of said hair brush, two prongs and an internal structure resembling a zigzagging path across a transverse plane of said hair brush;

said third floating finger has an elongate profile and extends only from said second floating finger;

at default configuration of said hair brush, said first, third and fourth floating fingers define respective longitudinal axes which are not in parallel with each other; and said plurality of floating fingers are fanned out at the distal end of said hair brush.

2. A hair brush as claimed in claim 1, wherein, partly due to difference in axial configuration of said plurality floating fingers, said brushing members extending from said floating fingers are configured to be able to reach different depths of hair configurations of a user during a hair styling exercise.

3. A hair brush as claimed in claim 1, comprising eight such said floating members altogether.

4. A hair brush as claimed in claim 1, wherein said floating fingers are of different lengths.

5. A hair brush as claimed in claim 1, wherein said brushing members include bristles or filaments, or both.

6. A hair brush as claimed in claim 5, wherein said bristles or filaments from said floating fingers have the same length.

7. A hair brush as claimed in claim 5, wherein said bristles or filaments from said floating fingers have different lengths configured to reach or to provide further accommodation to different hair volume or different hair thickness.

8. A hair brush as claimed in claim 1, wherein, at default configuration of said hair brush, said first and second floating fingers define different planes and said planes do not coincide with each other.

9. A hair brush as claimed in claim 1, wherein outwardly facing sides of said first and second fingers define respective surfaces which do not lie on or share a same plane.

10. A hair brush with an elongate profile defining a first longitudinal axis, said hair brush comprises a handle portion in the form of a stick sharing the first longitudinal axis and provided with a proximal end and an distal end, and said hair brush further comprises a utility portion extending from the distal end of said handle portion for engaging the hair and the scalp of a user during use, wherein:

said utility portion includes at least a first floating finger and a second floating finger forking off from the distal end of said handle portion; and at default configuration of said hair brush said first and second floating fingers define different planes in that the planes do not coincide with each other.

11. A hair brush as claimed in claim 10, wherein both said first floating finger and said second floating finger are provided with brushing members but independently and flexibly movable in any direction transverse to the first longitudinal axis such that said first and second floating members can separately adjust in position in response to different areas of the hair or scalp of a user, different hair configurations or head shapes of different users.

12. A hair brush as claimed in claim 10, wherein:

said first floating finger has an elongate profile extending from the distal end of said handle portion to a distal end of said hair brush;

said second floating finger has an overall elongate profile extending from the distal end of said handle portion to the distal end of said hair brush and an internal structure resembling a zigzagging path across a transverse plane of said hair brush;

said hair brush comprises a third floating finger with an elongate profile extended from said second floating finger; and said utility portion, in addition to said first and second floating fingers, comprises at least a fourth floating finger.

13. A hair brush as claimed in claim 12, wherein, at default configuration of said hair brush, said first, second, third and fourth floating fingers define respective longitudinal axes which are not in parallel with each other.

14. A hair brush as claimed in claim 10, wherein, partly due to difference in axial configuration of said floating fingers, said brushing members are configured to be able to reach different depths of hair configurations of a user during a hair styling exercise.

* * * * *